United States Patent [19]

Lehner

[11] 4,104,765

[45] Aug. 8, 1978

[54] CUTTING HARD FIBROUS MATERIAL

[75] Inventor: Peter Lehner, Hingham, Mass.

[73] Assignee: Leigh Textile Company, Boston, Mass.

[21] Appl. No.: 801,576

[22] Filed: May 31, 1977

[51] Int. Cl.[2] ..... D01G 1/04

[52] U.S. Cl. ..... 19/0.6

[58] Field of Search ..... 19/0.3–0.62, 19/1; 83/913; 57/2; 264/145, 148, 152

[56] References Cited

U.S. PATENT DOCUMENTS

| | | | |
|---|---|---|---|
| 2,173,789 | 9/1939 | Nikles et al. | 57/2 |
| 2,232,496 | 2/1941 | Thompson | 57/2 X |
| 2,302,354 | 11/1942 | Smith | 57/2 X |
| 2,719,336 | 10/1955 | Stotler | 19/0.51 |
| 2,830,327 | 4/1958 | Wildbulz | 19/0.6 |
| 3,915,042 | 10/1975 | Laird | 83/913 |

FOREIGN PATENT DOCUMENTS

| | | | |
|---|---|---|---|
| 1,435,491 | 12/1968 | Fed. Rep. of Germany | 19/0.32 |

*Primary Examiner*—Dorsey Newton

[57] ABSTRACT

Cutting hard fibrous material using a gap between cutting elements of a multiplicity of fiber thicknesses.

4 Claims, 3 Drawing Figures

FIG 1
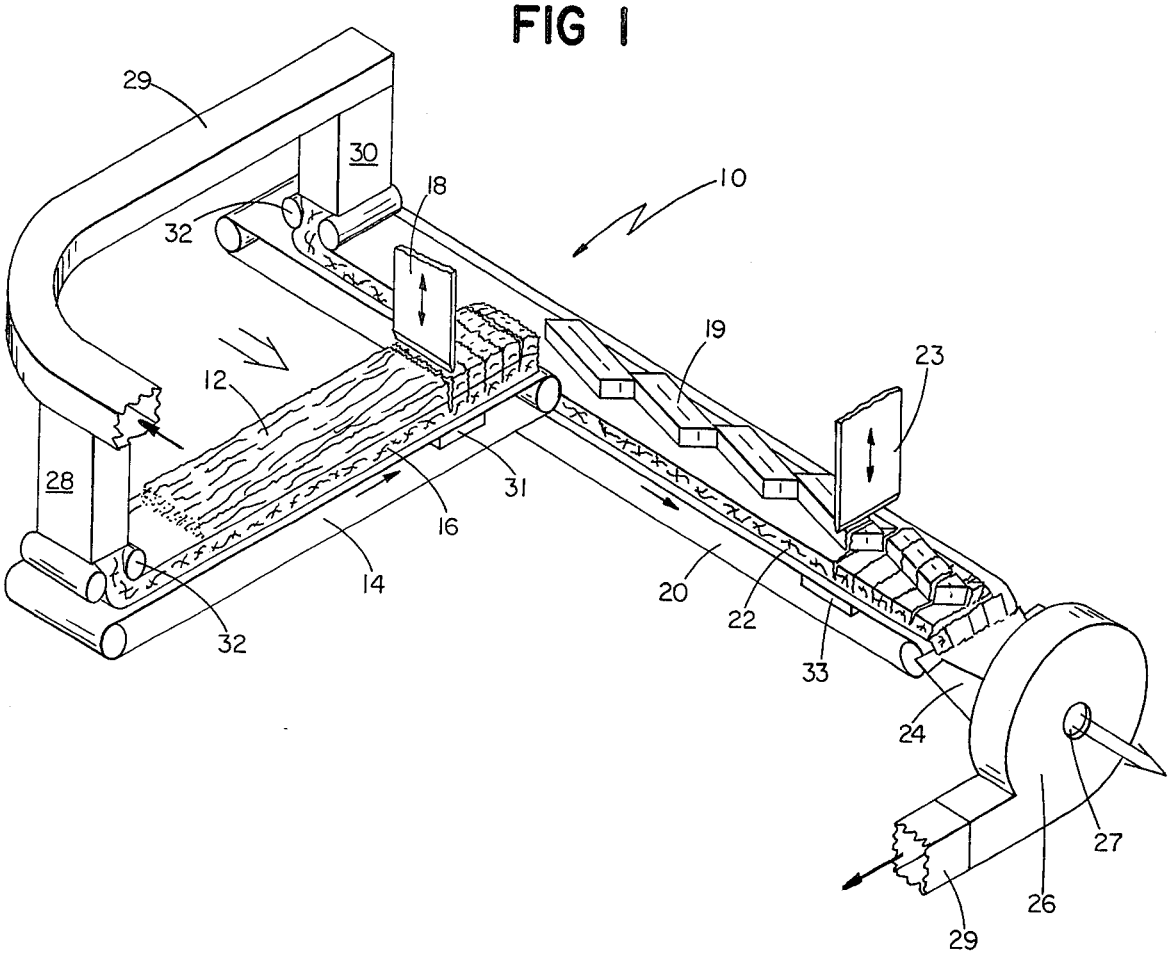
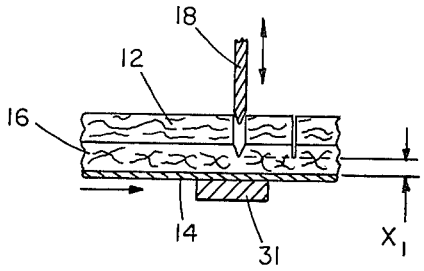
FIG 2
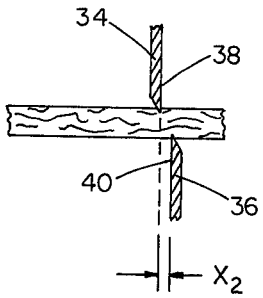
FIG 3

CUTTING HARD FIBROUS MATERIAL

FIELD OF THE INVENTION

This invention relates to cutting lengths of fibrous material, particularly of hard-to-cut fibers, as in recycling waste.

BACKGROUND OF THE INVENTION

Certain fibers are very difficult to cut. For example, Kevlar 49 (DuPont's trademark for one of its aramid fibers), is so hard (low modulus of elasticity) that, pressed against tool steel, the fiber embosses the steel. In addition, distribution of fibers along a blade (across the width of a moving belt), as occurs in cutting randomly oriented strands of waste material, will, due to the fiber hardness, subject those portions of the blade supported by a greater number of fibers (supported in turn by an anvil under the belt) to stresses causing harm to the blade edge. When making shear cuts using a blade and bed knife, the random strand orientation already mentioned means that some strands lie more nearly normal to the shear plane, while others lie more nearly parallel to it, again causing large localized stresses, harmful here to both blade and bed knife. High interfiber friction inhibits transverse (in the direction of blade thickness) sliding responsive to the horizontal component of the force imposed by the V-edged blades, which aggravates the cutting problem by increasing the peak cutting forces needed and heating of the fibers.

Prior efforts to cut such materials, using hardened steel or carbide blades and bed knives, and conventional anvils, have failed. The anvils have become embossed by the fibers, and the blade and bed knife edges have been broken down. And with thermoplastic fibers, the heat created by interfiber friction has fused fibers.

SUMMARY OF THE INVENTION

I have discovered that the problem may be solved by maintaining a gap of at least a multiplicity of fiber thicknesses between the cutting elements during the cutting stroke. With a blade and anvil as cutting elements, the solution is to use as an anvil a layer of the fiber in question, already cut to a shorter length, and to cut completely through the layer of longer fibers and partially through the layer of shorter fibers, leaving an uncut gap of at least a multiplicity of fiber thicknesses between the blade and anvil. In making shear cuts with a blade and bed knife, the gap is maintained between the facing surfaces of the blade and bed knife, but all fibers are cut. In preferred blade and anvil embodiments, conveyor belts move the two layers past the cutting elements, which cut at periodic intervals, and some of already-cut fibers are recycled through a blower and ducting to be deposited on the conveyor belts as the anvil layer.

Leaving this gap between the cutting elements alleviates the edge breakage caused by non-uniform fiber number and position distributions between the cutting elements. With more fibers left between the elements, non-uniformities are better averaged out. Further interfiber friction forces are reduced, by in effect now providing increased transverse fiber mobility, as needed in view of the transverse distance component of the V-shaped blade, so that less cutting force is needed and less heat is generated in the cutting process, helping to fusing of thermoplastic fibers and embossing of the anvil.

DESCRIPTION OF PREFERRED EMBODIMENTS

I turn now to description of presently-preferred embodiments of the invention.

DRAWINGS

FIG. 1 is an isometric view, somewhat diagrammatic, of a first embodiment of the invention.

FIG. 2 is a cross-sectional view taken through FIG. 1 at 2—2.

FIG. 3 is a diagrammatic cross-sectional view of a corresponding portion of a second, shear-cutting embodiment of the invention.

DESCRIPTION

There is shown in FIG. 1 a fiber-cutting machine, indicated generally at 10.

Waste material 12, composed of aramid fibers, tangled any many feet in length, is loaded in roughly five-inch layers onto first conveyor belt 14 on top of two-inch layer 16 of recycled cut fibers. Steel blade 18 cuts the two layers into segments 19 which fall onto second conveyor belt 20 on top of another layer 22 of recycled cut fibers. Platform 31 located underneath the conveyor belt supports the belt during the cutting operation. The blade cuts completely through the top layer of uncut fibers but only partially through the recycled cut fibers. An uncut gap $X_1$ of 3/64 inch is maintained between blade and belt (best shown in FIG. 2). Segments 19 are then cut, in similar fashion, by blade 23, with platform 33 supporting belt 20. The fibers then enter chute 24 leading to long-fiber-blow-through fan 26. Some pass through central opening 27 of the fan and into a storage container (not shown). About 40 percent of the cut fibers, however, are blown through duct 29 into feed chutes 28 and 30. The cut fibers emerge between exit rollers 32 at the outlet of the chutes, forming the beforementioned layer of recycled cut fibers.

Conveyor belt design follows conventional practice. Belts are made of rubber and have smooth top surfaces. Each conveyor is 20 inches wide. Blades 18 and 23 are of generally conventional design. Each is 18 inches wide, has a cutting wedge having an included angle of 130°, and is made of high-speed tool steel. The feed chutes are 16 inches wide and 4 inches deep. The fiber layers are roughly 17 inches wide.

An alternative embodiment is shown in FIG. 3. Blade 34 and bed knife 36 make shear cuts through the fibers. A gap $X_2$ of 10 fiber thicknesses (0.012 in. for 0.0012 in. fibers) is maintained between facing surfaces 38 and 40. The gap is selected large enough to prevent damage to the edges of the blade and bed knife, but not so large as to retard cutting. All fibers are cut through during each cutting stroke.

OTHER EMBODIMENTS

Other embodiments are within the scope of the description and claims. For example, the conveyor belts could be replaced by other fiber carriers, such as rotating drums. The gap between the cutting elements may be changed.

What is claimed is:

1. The method of cutting longer lengths of hard fibrous material into shorter lengths comprising:

depositing a first layer of said shorter lengths on a supporting surface;

loading a second layer of said longer lengths on top of said first layer; and moving a blade down through said first layer and into and partially through said second layer, leaving a gap between said supporting surface and said blade whereby relative movement of said fibrous material may take place in said gap.

2. The method of claim 1 in which some of said longer lengths cut into said shorter lengths by said blade are used as the layer of shorter lengths in subsequent cuts.

3. The method of claim 2 in which the cutting process is continuous, with a fraction of said shorter lengths being continuously recycled for use as said first layer.

4. A fiber-cutting machine for cutting longer lengths of hard fibrous material into shorter lengths comprising:

a conveyor belt support means for supporting thereon a lower layer of said shorter lengths and an upper layer of said longer lengths;

a blade mounted to cut down through said upper layer and into said lower layer a distance spaced from said support means;

a blower for recycling some of said shorter lengths, and ducting for directing the blower output for deposit as said lower layer.

* * * * *